US007401434B2

(12) United States Patent
Murello

(10) Patent No.: US 7,401,434 B2
(45) Date of Patent: Jul. 22, 2008

(54) HOLDING DEVICES TO ATTACH AN ACCESSORY TO A FIREARM

(75) Inventor: Johannes Murello, Deißlingen (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 11/363,774

(22) Filed: Feb. 28, 2006

(65) Prior Publication Data

US 2006/0207155 A1 Sep. 21, 2006

Related U.S. Application Data

(63) Continuation of application No. 10/754,759, filed on Jan. 9, 2004, now Pat. No. 7,036,261, which is a continuation of application No. PCT/EP03/01638, filed on Feb. 18, 2003.

(30) Foreign Application Priority Data

Feb. 26, 2002 (DE) ..... 102 08 127

(51) Int. Cl.
*F41G 1/387* (2006.01)

(52) U.S. Cl. ..... 42/127

(58) Field of Classification Search ..... 42/124, 42/125, 127

See application file for complete search history.

(56) References Cited

U.S. PATENT DOCUMENTS 2,043,430 A * 6/1936 Doe ..... 42/125
2,085,732 A 7/1937 Baxter et al.
2,587,248 A 2/1952 Turner
3,276,127 A * 10/1966 Abrahamson ..... 42/125
3,513,549 A 5/1970 Smiley
3,955,299 A 5/1976 Bullis
4,205,473 A * 6/1980 Wilson ..... 42/127
4,351,224 A 9/1982 Curtis
4,353,180 A 10/1982 Wilson
4,501,071 A 2/1985 Manske
4,562,658 A * 1/1986 Govett ..... 42/125
4,589,219 A 5/1986 Milliman ..... 42/73
5,056,410 A 10/1991 Pitts ..... 89/37.04

(Continued)

FOREIGN PATENT DOCUMENTS

DE GM 89 09 502 U1 10/1989

(Continued)

OTHER PUBLICATIONS

English Translation of International Search Report for international patent application PCT/EP03/01638 dated Sep. 7, 2003.

*Primary Examiner*—Stephen M Johnson
(74) *Attorney, Agent, or Firm*—Hanley, Flight and Zimmerman

(57) ABSTRACT

A holding device to attach one or more accessories to a firearm is disclosed. An example holding device disclosed herein comprises a top mount to engage one or more accessories, a bottom mount to engage the firearm, a fixing bore in one of the top mount and the bottom mount, a fixing pin in the other one of the top mount and the bottom mount, the fixing pin being dimensioned to insert into the fixing bore, a slider associated with the fixing bore, and a tensioning device to move the slider to cause the top mount and the bottom mount to move toward one another.

8 Claims, 4 Drawing Sheets

U.S. PATENT DOCUMENTS

| | | | | | |
|---|---|---|---|---|---|
| 5,144,752 | A | * | 9/1992 | Boeke et al. | 42/126 |
| 5,189,245 | A | | 2/1993 | Bundy | 42/76.02 |
| 5,375,361 | A | * | 12/1994 | Rustick | 42/125 |
| 5,519,953 | A | * | 5/1996 | Villani | 42/1.02 |
| 5,703,317 | A | | 12/1997 | Levilly et al. | 89/37.03 |
| 6,033,145 | A | | 3/2000 | Xu et al. | 403/256 |
| 6,594,938 | B2 | | 7/2003 | Horton | 42/127 |
| 7,036,261 | B2 | | 5/2006 | Murello | 42/127 |

FOREIGN PATENT DOCUMENTS

| | | | |
|---|---|---|---|
| DE | 41 33 242 | C | 10/1992 |
| DE | 43 05 087 | A | 8/1994 |
| DE | 298 22 816 | U | 4/1999 |
| GB | 175 676 | A | 2/1922 |

* cited by examiner

HOLDING DEVICES TO ATTACH AN ACCESSORY TO A FIREARM

RELATED APPLICATION

This patent issues from a continuation of U.S. patent application Ser. No. 10/754,759, which was filed on Jan. 9, 2004, now U.S. Pat. No. 7,036,261 and which is a continuation of International Patent Application Serial No. PCT/EP03/01638 which was filed on Feb. 18, 2003, which is hereby incorporated by reference in its entirety.

FIELD OF THE DISCLOSURE

This disclosure relates generally to firearms, and, more particularly, to a holding device to attach one or more accessories to a firearm.

BACKGROUND

In the following disclosure, positional terms such as "above" and "below" are used with reference to a gun in its normal firing position, that is, positioned to shoot "forward" (away from the shooter) in a generally horizontal plane.

Holding devices to attach, with precise positioning, an accessory device to a weapon are well-known in the art. For example, holding devices of this type are described in DE-GM 89 09 502 U1, GB 175 676 A, and, in a different field, U.S. Pat. No. 6,033,145. Holding devices of this type have many applications. One such application is to attach a precision optical-measurement accessory to a portal milling machine. In this example, the positioning of the accessory may need to be measured and adjusted several times a day depending on changes in the ambient temperature.

However, a more common application of a precision-positioning holding device is to attach an accessory, such as a telescopic sight, to a weapon, such as a rifle. Several issues may be encountered when attaching a telescopic sight to a rifle. For example, the attachment must be precise, because a divergence of the telescopic sight of only one (1) angular minute may produce an error of nine (9) cm at a distance of 300 m. Such an error can determine whether or not a target is hit successfully, especially considering the additional error introduced by the inherent spread of a sniper rifle. Another issue often encountered is that, depending on the particular situation, the telescopic sight must be easy to remove and reattach. Also, the holding device should be sufficiently strong and resilient so as to not wear out over time, that is, so as to provide a reproducible attachment of the telescopic sight to the rifle even after repeatedly detaching and reattaching the telescopic sight. Finally, the holding device should be able to withstand a reasonable amount of mechanical loading without misadjustment.

Telescopic sights used by the military are typically light in weight. Thus, if only a telescopic sight is to be mounted to the rifle, then a holding device having moderate strength and resilience should be sufficient. However, the holding device may be required to attach additional accessories that are coupled with the telescopic sight, such as night vision apparatus, distance-measuring equipment and many other options. In the latter case, the combined weight of all the accessories can easily exceed 2 kilograms, thereby requiring the use of a sufficiently strong and resilient holding device.

Holding devices traditionally used to attach telescopic sights on sniper rifles of the former East Germany are not adequate for securing the combined set of accessories described previously. In a typical holding device, a fixing pin is arranged on the barrel above the cartridge chamber and an opposite engagement formation sits on the bridge above the rear side of the magazine chamber. The fixing pin and the engagement formation are attached to the bottom side of the telescopic sight. The telescopic sight is initially held transverse to the axis of the bore of the rifle in a generally horizontal plane. The fixing pin is located with its vertical axis over a fixing bore. The fixing pin is introduced into the bore all the way to the back stop and the telescopic sight is then swiveled into a position parallel to the axis of the bore. Through this motion, ridges on the fixing pin engage underneath counter-ridges in the fixing bore, thus pressing the fixing pin to the bottom part of the holding device. At the same time, the engagement formation on the telescopic sight snaps into a counter-formation on the rifle, and complementary inclined recesses and projections press the engagement formation to the bottom part of the holding device. These ridges/counter-ridges and recesses/projections guide the attachment of the telescopic sight to the firearm and hold these pieces firmly together. The engagement formation has some amount of longitudinal clearance, which, however, does not negatively affect the alignment of the optical axis of the telescopic sight and the axis of the bore of the firearm.

The known holding devices described above are constructed so that they can be assembled and disassembled quickly. Moreover, the distance between the pin and the engagement formation typically has a tight tolerance. As a result, these holding devices are usually costly to manufacture as they require a considerable amount of manual work to fabricate their constituent components. Furthermore, if the telescopic sight is coupled with the above-mentioned accessories (e.g., night vision devices, distance-measuring equipment, etc.), then the increased surface pressure may cause the holding device to fatigue more quickly than expected.

To increase the strength and resilience of a traditional holding device, it may be possible to enlarge its constituent components by a proportional amount. However, this would result in a more costly, heavier design.

DETAILED DESCRIPTION

Figure 1:
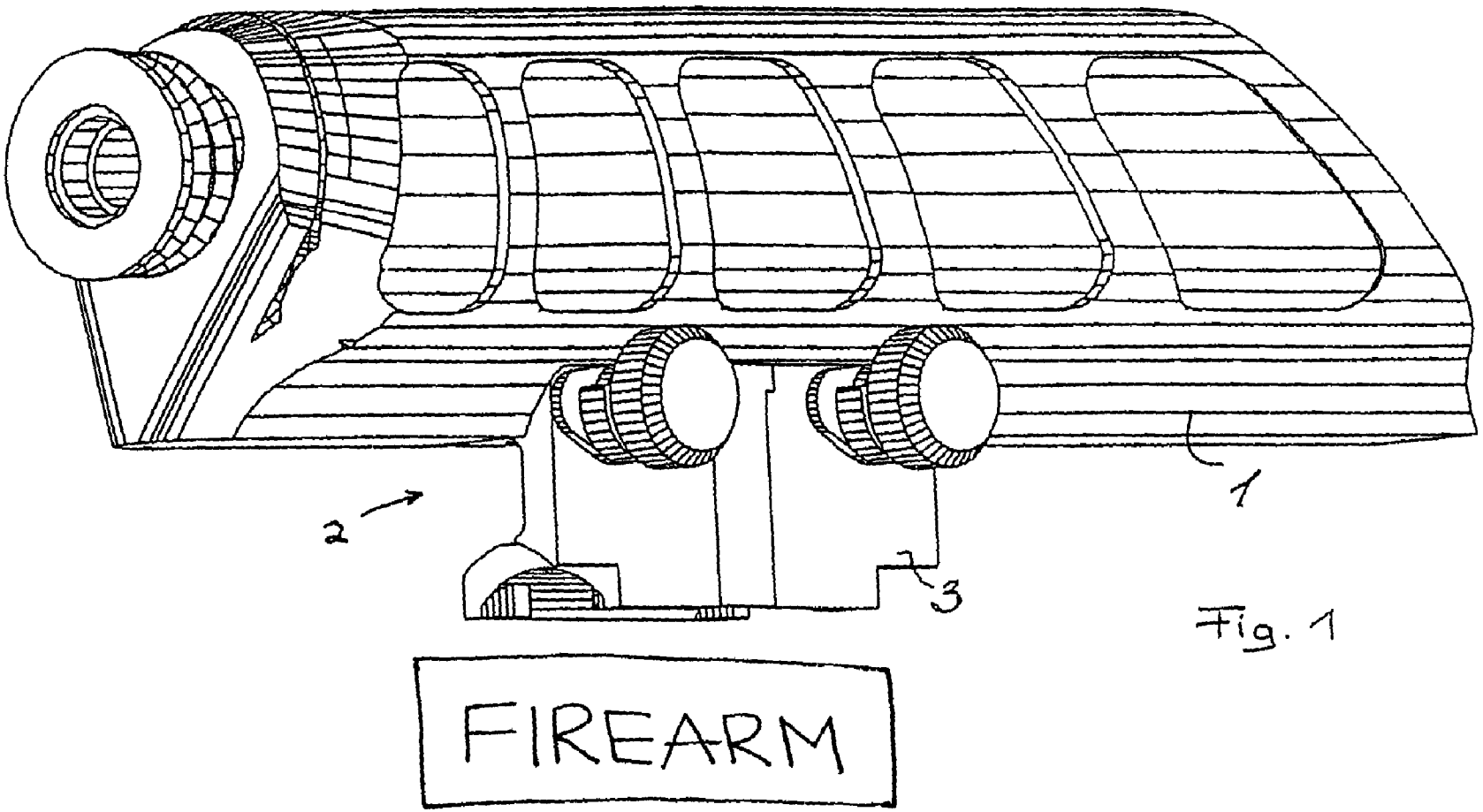
FIG. 1 is a perspective view of an example holding device.
Figure 2:
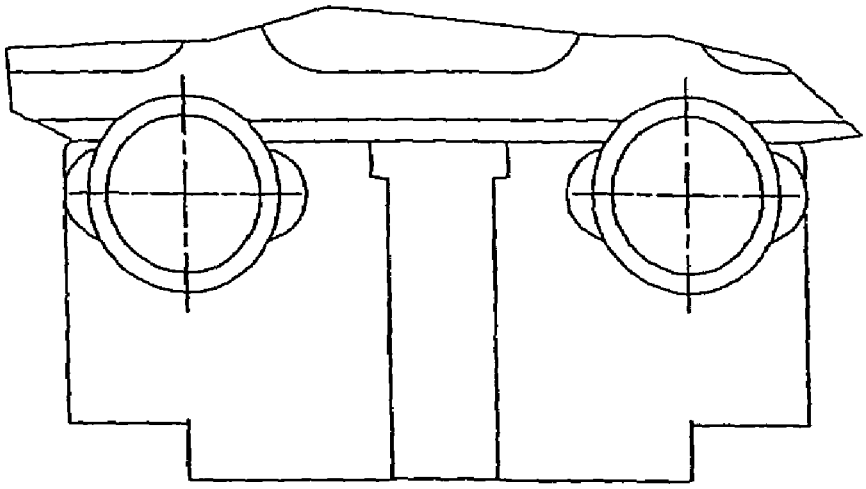
FIG. 2 is a right side view of the example holding device of FIG. 1 (e.g., as viewed facing the illustration in FIG. 1).

FIGS. 1-7 depict the same example holding device. Therefore, the same reference numbers apply to all figures, even if not shown. The following description assumes the illustrated holding device is oriented in a normal shooting position in which the barrel of a firearm is held by the marksman in a generally horizontal position. In FIG. 1, the barrel of the firearm is pointing in the forward direction. References to positions such as "right" or "top" match the view of the marksman who is holding weapon at the ready.

In the example shown in FIG. 1, an optical electronic accessory 1, such as a telescopic sight, is mounted on the upper side of a rifle (not shown) by a holding device 2. The top part of the holding device 2 may be integrated into the accessory 1. Therefore, reference symbol 1 is used both for the optical electronic accessory and the top part (hereinafter referred to as the "top mount") of the holding device 2.

The top mount 1 is mounted on a bottom part 3 (hereinafter referred to as the "bottom mount") of the holding device 2, which is either integrated in or mounted to a firearm, such as a rifle. Therefore, in the following description, reference symbol 3 is used not only for the bottom mount but also for the firearm.

Figure 5:
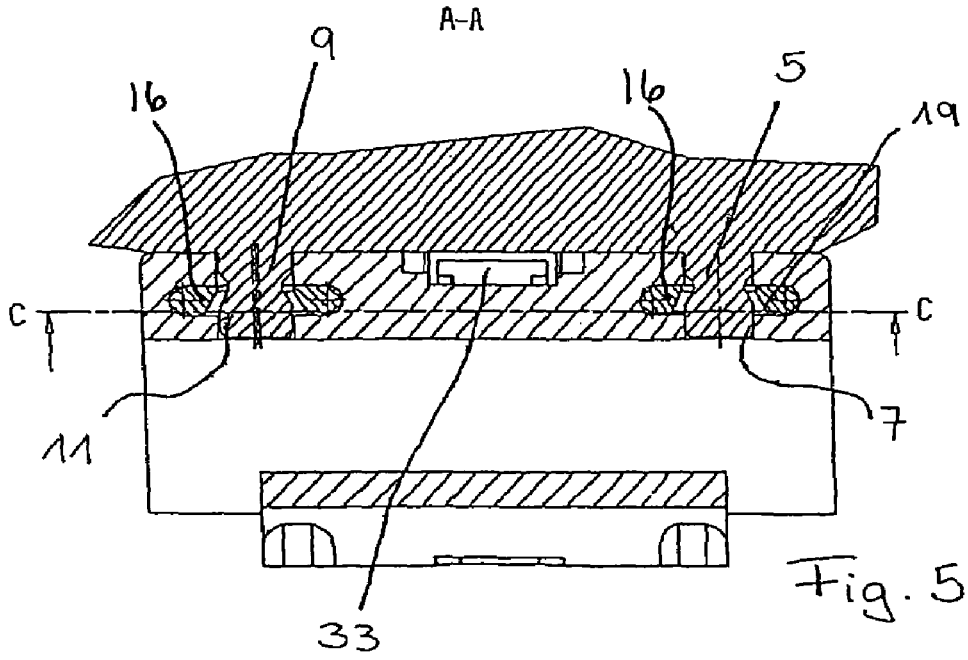
FIG. 5 is a cross-sectional view of the example holding device of FIG. 1 taken along line A-A in FIG. 3.
Figure 6:
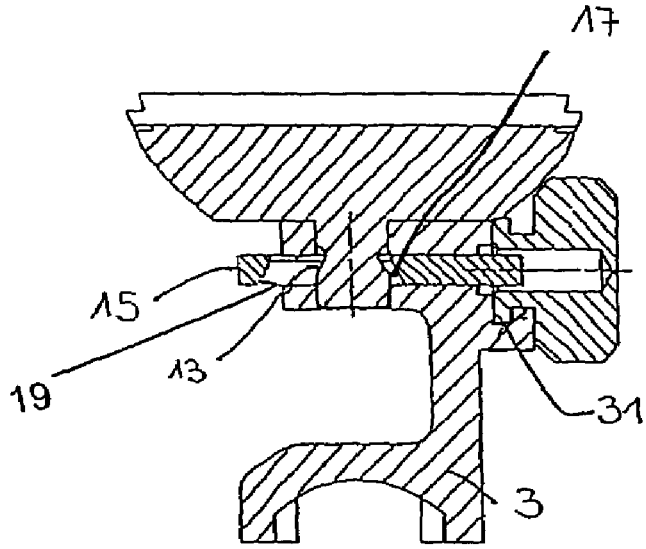
FIG. 6 is a cross-sectional view of the example holding device of FIG. 1 taken along line B-B in FIG. 4.

In the example of FIG. 5, the top mount 1 comprises, on its bottom side, two cylindrical fixing pin 5, 9 with similar dimensions and vertical axes, and made, for example, of steel. The diameter of these fixing pins 5, 9 has a narrow tolerance. Conversely, the distance between pins 5, 9 has a wide tolerance as may be seen in FIGS. 5 and 7 in which several possible middle axes are shown for the front fixing pin 9. As shown in FIG. 6, each fixing pin 5, 9 comprises, close to its bottom edge, a ring groove 13, whose lower side wall is beveled to the bottom and to the outside so that this side wall comprises a tapered surface.

The bottom surface of the top mount 1, from which the two fixing pins 5, 9 project, is smooth and comprises either the female or the male component of a plug-and-socket connection 33 (see FIG. 5). This component engages its counterpart male or female component of the plug-and-socket connection 33 on the bottom mount 3. Thus, the plug and socket connection 33 forms a protected, and possibly sealed, system that can be used to establish an electrical connection between the top mount 1 and the bottom mount 3.

The bottom part 3 is preferably made of lightweight metal and comprises a smooth upper surface, thereby providing a secure fit with the top mount 1. In the example of FIG. 5, the upper surface of the bottom mount 3 contains a rear fixing bore 7 and a front slotted hole 11. The distance of these bores 7, 11 is dimensioned so that the two fixing pins 5, 9 can be inserted into the respective bores 7, 11.

The rear fixing bore 7 is dimensioned in such a manner that the respective fixing pin 5 may be inserted with a narrow tolerance. The slotted hole 11 has a transverse dimension (the side-to-side dimension visible in FIGS. 3 and 6) with a similarly narrow tolerance as the diameter of fixing bore 7, but with a wider tolerance for longitudinal dimension (the front-to-back dimension visible in FIG. 5).

Figure 3:
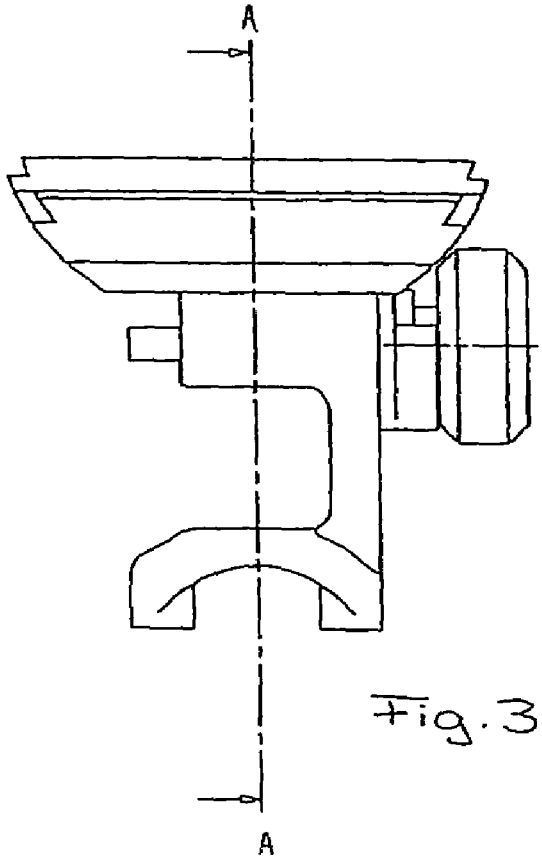
FIG. 3 is a rear view of the example holding device of FIG. 1 (e.g., as viewed from the left side of the illustration in FIG. 1).

As shown in FIGS. 3 and 6, the bottom mount 3 is designed as a sideways lying "U" shape that comprises two horizontal wings connected by a vertical section. The thickness of the upper wing, which comprises the bores 7, 11, is about equal to the free length of fixing pins 5, 9 so that bores 7, 11 are designed as through-holes. Thus, any impurity that becomes lodged in any of the bores is easily removed whenever the top mount 1 is inserted into the bottom mount 3.

Figure 4:
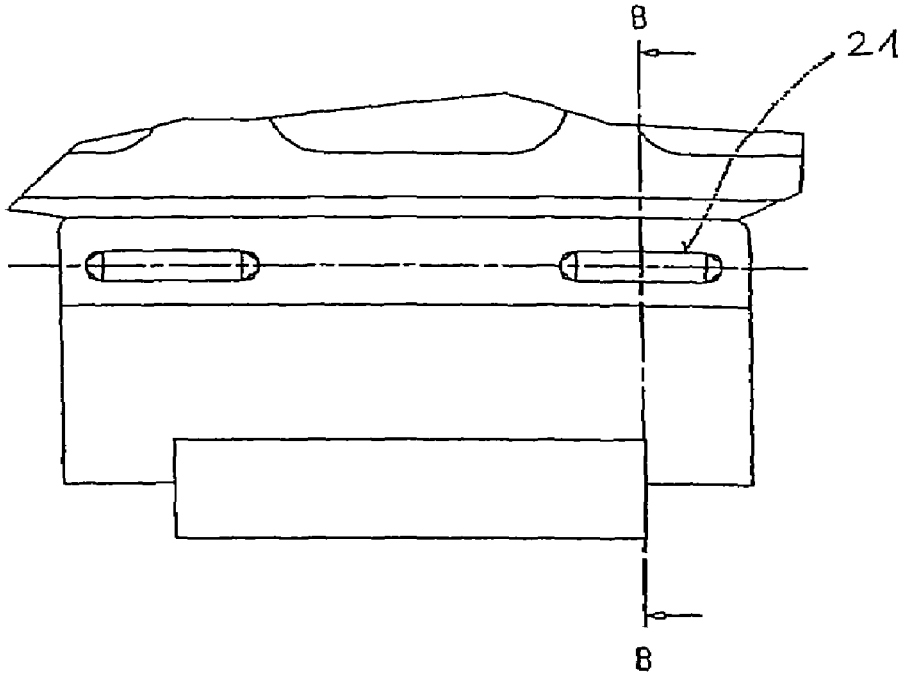
FIG. 4 is a left side view of the example holding device of FIG. 1 (e.g., corresponding to the side opposite to the view in FIG. 2).
Figure 7:
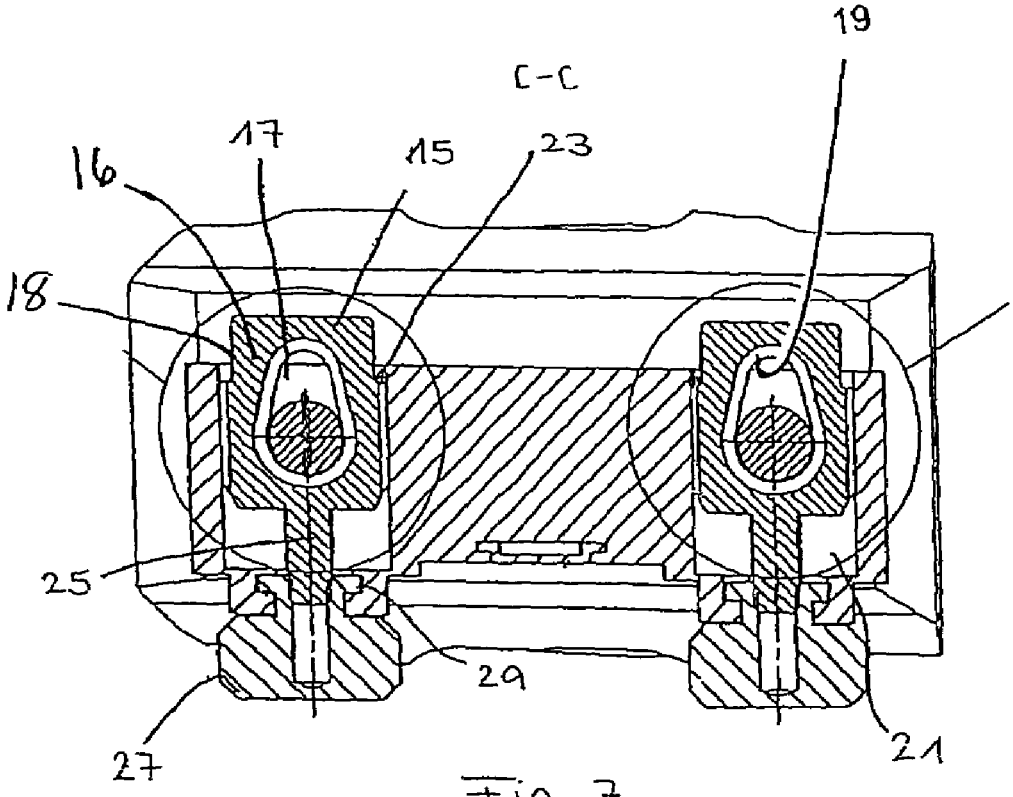
FIG. 7 is a cross-sectional view of the example holding device of FIG. 1 taken along line C-C in FIG. 5.

As shown in FIGS. 4, 6 and 7, the upper horizontal wing of the example holding device 2 contains two horizontal slotted holes 21. Each hole 21 opens at the left front surface of the upper wing, extends horizontally through the wing, and ends as a pocket bore near the right surface of the upper wing. A cylindrical through-hole is located near the lower, central portion of each of these slotted holes 21. The slotted holes extend horizontally with their axes extending in a transverse direction.

As shown in FIG. 7, flat sliders 15 are inserted into the slotted holes 21. The slider 15 ends in a central spindle 25 that is threaded. The spindles 25 extend into the through-holes located in the lower, central portions of the slotted holes 21, also known as slider grooves 21.

The center portion of each slider 15 is a lug 16 that defines an opening 17, whose edge 19 is beveled to the bottom and to the outside. The opening 17 of the lug 16 is symmetric about the longitudinal axis of the slider 15. Near the end facing the spindle 25, the radius of the opening 17 is somewhat larger than the diameter of one of the fixing pins 5, 9. Near its other end, the opening 17 has a radius that is preferably somewhat smaller than the inner radius of the ring groove 13. The fixing pins 5, 9 penetrate the opening 17 of their respective sliders 15 as shown in FIG. 7.

When the accessory 1 is first attached to the rifle 3, the sliders 15 are located in their extreme left position, as illustrated in FIG. 7. A knurled nut 27 is screwed onto each spindle 25 such that the nuts 27 are proximate to the outer side of the slider groove 21 near the location where groove 21 is penetrated by the spindle 25. Tightening the nuts 27 pulls the slider 15 towards the nut 27 thereby causing the slanted surface 19 of the opening 17 of the lug 16 to move against the lower slanted surface of the ring groove 13. Thus, tightening the nut 27 causes the fixing pins 5, 9 to be pulled downward and pressed against the right wall of the respective fixing bore 7, 11. On the side opposite of the fixing pins 5, 9, the opening 17 of the lug 16 rests on two points so that a firm and reliable, "three-point" attachment is achieved. The resulting force by which the sliders 15 pull down fixing pins 5, 9 produces a strong friction between the top mount 1 and the bottom mount 3 that is able to counter a significant portion of any transverse forces that may be imparted on the holding device 2.

Both sides of the lug 16 of each slider 15 have a wedge-shaped tapering that allows the slide 15 to slide, with very low friction, on the edge of the slider groove 21. In addition, sufficient clearance is provided between the sides of the lugs 16 of each of the sliders 15 and the edges of the corresponding slider grooves 21 in order to avoid the possibility of jamming the action of the holding device. A wedge shape is preferred because the slider groove 21 can then be manufactured cost-efficiently by using a milling cutter.

Side grooves 18 are located along the side edges of the lugs 16 of the sliders 15 near the free end of the lugs 16. These side grooves 18 may be open-ended towards the free end of the lugs 16 of the sliders 15. A vertical stop pin 23 is placed at the edge of each slider groove 21. The stop pins 23 operate with the ends of the side grooves 18 of the lugs 16 to prevent their corresponding slider 15 from inadvertently falling out of the slider groove 21, and potentially becoming lost, when the accessory 1 is not mounted on the rifle 3.

As shown in FIGS. 6-7, each nut 27 comprises a collar 29 that may be inserted into a corresponding half-ring-shaped recess 31 located on the right side of the bottom mount 3. The collar 29 should be inserted into the recess 31 before the nut is screwed onto the corresponding spindle 25 and before the security pin 23 is inserted into the bottom mount 3. As a result, once the nut 27 has been screwed onto the spindle 25, the nut 27 cannot unscrew and inadvertently fall off the spindle 25 and possibly become lost. Moreover, each nut 27 in combination with its associated collar 29 exerts transverse forces upon the corresponding slider 15, should the slider 15 become stuck on the fixing pins 5, 9.

As already mentioned, the bottom mount 3 is preferably made of lightweight metal, whereas sliders 15, and possibly nuts 27, are preferably made of steel. To avoid rusting, for example, due to the introduction of salty water into the holding device 2, the nuts 27 can also be made of brass or another suitable material.

The example holding device 2 described herein may be constructed so as to be cost efficient yet able to securely mount potentially heavy accessories to a firearm. In the example holding device 2, the apparatus for securing and positioning the accessories comprises a slider 15 able to move transversely to the axis of the fixing pin 5 and an engagement formation 9. A slider 15 is coupled with either or both of the fixing pin 5 and the engagement formation 9. The slider 15 has a beveled surface 19 that causes the slider 15 to draw the fixing pin 5 and the engagement formation 9 to the fixing bore 7 and the counter-formation 11, respectively, as the slider 15 is tightened. As a result of this arrangement, the operation of placing an accessory on the firearm and the operation of securing and precisely positioning the accessory are separate (in contrast to the prior art in which the accessory is held in a specific orientation with respect to the firearm and undergoes a specific motion to simultaneously place the attachment on the firearm and secure the attachment to the firearm). Moreover, this arrangement results in a simple design. Also, the fixing pin 5 and the counter-formation 11 can be dimensioned so that the accessory is securely mounted to the firearm such that transverse forces are absorbed by the friction of the mounting surfaces and, therefore, are unlikely to cause misalignment of the fixing bore 7 and the counter-formation 11.

In the example holding device 2, the fixing bore 7 and fixing pin 5, as well as the counter-formation 11 and engagement formation 9, are simpler than in traditional holding devices because the movement of the slider 15 replaces the swiveling motion associated with the traditional devices. Thus, the operation of swiveling the accessory prior to attaching and securing it to the firearm is no longer required.

In contrast to traditional holding devices, the fixing pin 5 of the example device 2 described herein need not be inserted laterally into the fixing bore 7 and then secured by turning (e.g., swiveling) the accessory. Rather, the fixing pin 5 can be inserted from the top and straight into the fixing bore 7. Thus, the fixing pin 5 need not have a round cross-section. However, it is preferred that the fixing pin 5 have a round cross-section, that the peripheral wall of the fixing bore 7 be closed at its muzzle, and that the fixing pin 5 comprise, near its free end, a groove 13 to engage with the slider 15. Also, the fixing pin 5 need not comprise a ridge or protrusion. Rather, the slider 15 could engage the pin 5 in a groove or a corresponding recess. Therefore, the fixing pin 5 can be made of a round material with high precision but at a low cost. Thus, the fixing pin 5 is preferably designed as a rotational body.

The engagement formation 9 is also preferably implemented as a pin 9 that is similar to the fixing pin 5. Thus, the holding device 2 may comprise two pins 5, 9 of similar diameter. However, it may be desirable to construct the pins 5, 9 to have different diameters so that the accessory cannot be mounted with an incorrect orientation.

If the engagement formation 9 is constructed similarly to the fixing pin 5, then the counter-formation 11 can be constructed as a slotted hole 11 whose width matches the pin-like engagement formation 9. The linear extension of the slotted hole 11 faces the fixing pin 5. Therefore, the distance between the two pins 5, 9 of the top mount 1 (which can actually be designed to comprise two components) may have a wide tolerance. Should any divergence occur in the direction transverse to the axis of the two pins 5, 9, this divergence can be corrected due to the adjustable nature of the example holding device 2.

There is flexibility in the arrangement of the fixing pin 5 and the engagement formation 9 provided they are accessible from the same side. The engagement formation 9 may also comprise two or more individual pins located separate from each other. However, it is preferred that the fixing pin 5 and the engagement formation 9 be arranged such that their centers lie along an axis parallel to the longitudinal axis of the bore of the rifle. Such an arrangement is consistent with the positioning of a normal telescopic sight and, thus, meets the expectations of a marksman with regards to the attachment of the accessory to the firearm.

The slider or sliders 15 can be movable in many directions. However, the direction transverse to the central axis of the fixing pin 5 or the engagement formation 9 is the preferred direction of motion. Furthermore, the slider 15 should be movable in the direction transverse to an axis connecting the centers of the fixing pin 5 and the engagement formation 9. This ensures a good clamping effect.

The slider 15 may be a wedge that engages in the recess of the fixing pin or pins 5 and presses the pin or pins 5 strongly against the bottom mount 3. However, an asymmetrical engagement could damage one or more of the retaining bores (e.g., the fixing bore 7 or the slotted hole 11). Therefore, it is preferred that the sliders 15 contain lugs 16 that define openings 17 which are symmetric about the axes of motion of the sliders 15. Both ends of the openings 17 should be rounded so that the rounding diameter at one end of the opening 17 is larger than that of the fixing pin 5, and the rounding diameter at the other end of the opening 17 is smaller than that of the fixing pin 5. The slider 15 may be pressed by a tensioning device so that the end of the opening 17 having the smaller diameter is pressed into the groove 13 of the fixing pin 5. Thus, the slider 15 transfers little to no lateral force from the bottom mount 3, even though these lateral clamping forces could be large.

A strong spring could be used as the tensioning device described above. Another option is to use an eccentric. However, a spring is less advantageous because the elastic force of the spring must be overcome to loosen the slider 15 and remove the attached accessory. Therefore, in the illustrated examples, the tensioning device is implemented as a concentric draw spindle 25 combined with a nut 27 located on the external side of the bottom mount 3. Very large forces may be exerted on draw spindles 25, even if the spindles are very thin. This is also the case for an eccentric.

In the illustrated holding device 2, these draw spindles 25 are thick enough to transfer substantial compressive forces, thereby allowing the nut 27 to be axially fixed yet able to turn freely. Thus, depending on the direction of turning, the nut 27 may transfer traction forces or compressive forces to the draw spindle 25. To remove the attached accessory, turning the nut 27 is sufficient to loosen even a firmly tightened slider 15. An end stop 23 prevents the slider 15 from inadvertently falling out of the holding device and possibly becoming lost. The axial fixing of the nut 27 prevents the nut 27 from inadvertently falling off of the spindle 25 and possibly becoming lost as well.

To firmly secure the top mount 1 and the bottom mount 3, the fixing pin 5 and/or the engagement formation 9 may comprise a peripheral groove 13. The edge of the groove 13 that faces the free end of the pin 5 or engagement formation 9 is beveled in the direction of this free end. The opening 17 of the slider 15 may be defined by a beveled edge 19 in the corresponding lug 16 that is tapered away from the free edge of the fixing bore 7 and/or the slotted hole 11. Thus, fastening of the slider 15 causes the top mount 1 and the bottom mount 3 to be drawn together. The beveled edge of the lug 16 defining the opening 17 and the beveled lateral wall of the groove 13 act together to pull the respective fixing pin 5, 9 of the top mount 1 to the bottom mount 3, thus securing the top mount 1 firmly to the bottom mount 3.

The bottom mount 3 is preferably designed as a one-component body that can be permanently attached to the firearm. The bottom mount 3 should be made of metal (preferably a light metal) to form a base that is resistant to bending and that can be either mounted to the firearm or integrated into the firearm.

The forearm, or handguard, of the firearm may be constructed, at least in part, from synthetic material that is moldable. However, the firearm system integrated with the forearm comprises a firm zone. Therefore, the bottom mount 3 should be mounted to this firm zone or integrated into this firm zone.

The bottom mount 3 comprises an almost continuous surface between the fixing bore 7 and the counter-formation 11. The top mount 1 comprises an almost continuous surface between the fixing pin 5 and the engagement formation 9. Upon engagement of the sliders 15, these surfaces are pressed firmly together, thereby transferring any lateral forces throughout the surface area of the top mount 1 and the bottom mount 3. By distributing these forces in this manner, the allowed pressure per unit area is not exceeded.

The example holding device 2 described herein provides for the precision-positioning attachment of two components, for example, the attachment of an accessory 1, such as a telescopic sight, to a weapon 3, such as a portable firearm. The example holding device 2 comprises a bottom mount 3 formed in or permanently mounted to the firearm 3, and a top mount 1 mounted to or formed in the accessory 1, thereby allowing quick assembly and disassembly of the firearm 3 and the accessory 1. The top mount 1 and the bottom mount 3 interlock in a precise position and reproducible manner. At least one fixing pin 5 and a separate engagement formation 9 are arranged on the top mount 1 or the bottom mount 3. The opposing bottom mount 3 or top mount 1 comprises a fixing bore 7 designed for the precise positioning of the fixing pin 5, and an opposite formation 11 designed so as to be complementary with the engagement formation 9. The opposite formation 11 is arranged such that its orientation is fixed perpendicularly to the intended connection of the fixing pin 5 and the engagement formation 9, but has a tolerance in the direction of the intended connection. The fixing bore 7 and the opposite formation 11 comprise means 15 for attaching and securing the accessory 1 to the firearm 3 in order to prevent any loosening in the direction of the fixing pin 5.

In the illustrated holding device 2, the apparatus for attaching and securing the top mount 1 with the bottom mount 3 comprises a slider 15 able to move transversely to the axis of the fixing pin 5 and the engagement formation 9. A slider 15 may be coupled and firmly clamped to either or both of the fixing pin 5 and the engagement formation 9. The slider 15 and the corresponding fixing pin 5 and/or engagement formation 9 comprise a beveled surface 13, 19. The beveled surface 13, 19 causes the fixing pin 5 and engagement formation 9 to press against the fixing bore 7 and the counter-formation 11, respectively, as the slider 15 is tightened.

Although certain example methods and apparatus have been described herein, the scope of coverage of this patent is not limited thereto. On the contrary, this patent covers all methods and apparatus fairly falling within the scope of the appended claims either literally or under the doctrine of equivalents.

What is claimed is:

1. A holding device to attach at least one accessory to a firearm comprising:

a top mount;

a bottom mount associated with the firearm;

first and second fixing bores in one of the top mount and the bottom mount; and first and second fixing pins in the other one of the top mount and the bottom mount, the first fixing pin being cylindrical and dimensioned to insert into the first fixing bore, the second fixing pin being cylindrical and dimensioned to insert into the second fixing bore, at least one of the first and second pins having a camming surface;

a cam positioned to selectively engage the camming surface to fix the at least one of the first and second pins in a corresponding one of the first and second fixing bores; and an actuator to move the cam in a direction toward a vertical axis of at least one of the first and second pins to cause the cam to engage the camming surface, wherein the cam comprises a slider having a threaded end, and the actuator comprises a nut dreaded on the threaded end.

2. A holding device as defined in claim 1 wherein the direction is substantially perpendicular to the vertical axis.

3. A holding device as defined in claim 1 wherein the first and second fixing bores are through holes.

4. A holding device as defined in claim 1 wherein the first and second pins are not threaded.

5. A holding device as defined in claim 1 further comprising a plug and socket connection disposed between the first and second pins.

6. A holding device as defined in claim 5 wherein the plug and socket connection is sealed to protect an electrical connection.

7. A holding device as defined in claim 1, further comprising a security pin to prevent the slider from being separated from the holding device when the accessory is not attached.

8. A holding device as defined in claim 1, wherein die first fixing pin and the second fixing pin have different diameters.

* * * * *